US007754104B2

(12) United States Patent
Datta et al.

(10) Patent No.: US 7,754,104 B2
(45) Date of Patent: Jul. 13, 2010

(54) COMPOSITION OF LACTATE ESTERS WITH ALCOHOLS WITH LOW ODOR AND ENHANCED PERFORMANCE

(75) Inventors: Rathin Datta, Chicago, IL (US); James E. Opre, Downers Grove, IL (US)

(73) Assignee: Vertec Biosolvent, Inc., Mt. Prospect, IL (US)

( * ) Notice: Subject to any disclaimer, the term of this patent is extended or adjusted under 35 U.S.C. 154(b) by 0 days.

(21) Appl. No.: 11/781,450

(22) Filed: Jul. 23, 2007

(65) Prior Publication Data

US 2008/0029740 A1 Feb. 7, 2008

Related U.S. Application Data

(60) Provisional application No. 60/834,623, filed on Aug. 1, 2006.

(51) Int. Cl.
*C23G 5/00* (2006.01)

(52) U.S. Cl. ..... 252/364; 510/108; 510/210; 510/405; 510/417

(58) Field of Classification Search ..... 252/364; 510/201, 417, 108, 408
See application file for complete search history.

(56) References Cited

U.S. PATENT DOCUMENTS

| | | | | |
|---|---|---|---|---|
| 3,806,593 | A * | 4/1974 | Swanbeck et al. | 424/401 |
| 4,052,515 | A * | 10/1977 | McDermott et al. | 514/724 |
| 5,482,645 | A * | 1/1996 | Maruyama et al. | 510/407 |
| 6,096,699 | A | 8/2000 | Bergemann et al. | |
| 6,191,087 | B1 | 2/2001 | Opre et al. | |
| 6,797,684 | B2 | 9/2004 | Henneberry et al. | |
| 6,844,307 | B1 * | 1/2005 | Sumner | 510/417 |
| 2003/0171241 | A1 * | 9/2003 | Henneberry et al. | 510/417 |
| 2004/0161436 | A1 * | 8/2004 | Hull | 424/401 |
| 2005/0079228 | A1 * | 4/2005 | Jaiswal et al. | 424/641 |
| 2005/0079236 | A1 * | 4/2005 | Ahrens | 424/736 |

FOREIGN PATENT DOCUMENTS

WO WO 2006-065935 A2 * 6/2006

* cited by examiner

*Primary Examiner*—Harold Y Pyon
*Assistant Examiner*—Haidung D Nguyen
(74) *Attorney, Agent, or Firm*—Husch Blackwell Sanders Welsh & Katz

(57) ABSTRACT

A solvent composition of about 90 to about 10 percent by weight $C_1$-$C_4$ lactate ester and about 10 to about 90 percent by weight $C_2$-$C_6$ aliphatic alcohol with low odor and enhanced performance properties is disclosed. This composition can also be mixed with other solvents and continue to provide the low odor and enhanced performance properties.

9 Claims, No Drawings

COMPOSITION OF LACTATE ESTERS WITH ALCOHOLS WITH LOW ODOR AND ENHANCED PERFORMANCE

CROSS-REFERENCE TO RELATED APPLICATION

This application claims benefit of provisional application Ser. No. 60/834,623 that was filed on Aug. 1, 2006.

BACKGROUND ART

Ethyl lactate and other lactate esters are environmentally benign, non-toxic solvents derived from renewable carbohydrates via fermentation and separation processes. Ethyl lactate, for example, has very good solvent properties and a characteristic odor. Lactate esters can also be blended with fatty acid esters and other ester containing solvents to provide biosolvent blends with enhanced solvating, cleaning and penetration properties. For example U.S. Pat. No. 6,096,699 and No. 6,191,087 teach that lactate esters such as ethyl lactate blended with fatty acid esters such as methyl esters of soy oil fatty acids can be used for a variety of solvent cleaning, metal degreasing, paint and varnish removal applications. In another recent U.S. Pat. No. 6,797,684 B2, teaches that blends of lactate esters and d-limonene, a biobased solvent that is derived from citrus fruits have improved cleaning and solvent properties.

Lactate esters can emit an odor whose perception and tolerance can inhibit commercial acceptance of products containing them. Even in the blended solvents that are in the above-mentioned patents and other formulated products that have high concentrations of lactate esters, this odor perception and tolerance is difficult to overcome.

Another recent U.S. Pat. No. 6,890,893 B2, teaches a low odor composition for lactate esters and other ester biosolvents. This patent was based on the unexpected discovery that addition of small amounts of certain tertiary amines to lactate esters or ester solvent blends enhances the odor tolerance and reduces or eliminates the lingering bite/irritation sensation that appears after long or continuous exposure to these solvents. However, these amines have their characteristic ammonia like odor that is not desired in many general solvent applications. Furthermore, these amines may be reactive with various ingredients or components in solvent formulations. Furthermore, these amines are not really solvents and do not contribute to the solvating, drying or other properties that are required. Thus, even though the odor and tolerance properties were improved, other drawbacks that are described above limited their widespread use.

Aliphatic alcohols, either linear or branched, such as ethanol, iso-propanol, n-butanol, iso-butanol, n-pentanol or hexanol are some large volume chemicals that are widely used as solvents, reactants and as components of many formulations. Some of these alcohols, particularly ethanol, are now being made from renewable resources such as sugar cane, corn and other carbohydrate sources, in very large volumes as alternative liquid fuel for addition to gasoline.

In the past, n-butanol has also been made in very large quantities via fermentation of carbohydrates. Just recently, two major international energy and chemical companies, BP and Dupont, announced joint development and commercialization of 'Biobutanol' that will be derived from renewable carbohydrates, and will be used as an enhanced alternative fuel with ethanol, for blending into gasoline. Thus, some of the major alcohols are currently or soon becoming biobased products derived from renewable resources.

From the viewpoint of solvents, these alcohols lack some of the desirable properties namely, high solvency for a wide variety of polymers, too rapid drying rates particularly for ethanol, iso-propanol and n-butanol, low flash points and other properties. Lactate esters that have good solvating properties as well as low drying rates and high flash point can be considered as good blend solvents to improve the alcohols' solvent properties. It has now been discovered that blending lactate esters with the alcohols not only enhances the alcohols' solvent properties but also overcomes the odor and tolerance problems associated with the lactate esters. This result enables more widespread use of the solvent blends and growth of biobased solvents from renewable resources to replace petrochemically derived solvents.

BRIEF SUMMARY OF THE INVENTION

The present invention contemplates a solvent blend of $C_1$-$C_4$ aliphatic esters of lactic acid and $C_2$-$C_6$ alcohols with low odor, high odor tolerance and enhanced solvent properties. A contemplated solvent composition comprises about 90 to about 10 percent by weight $C_1$-$C_4$ lactate ester and about 10 to about 90 percent by weight $C_2$-$C_6$ aliphatic alcohol. The composition (a) exhibits a reduced amount of odor due to the lactate ester compared to the lactate ester alone and (b) is a homogeneous liquid (exhibits a single liquid phase) at zero degrees C.

Also particularly contemplated is a solvent composition as above that comprises a $C_1$-$C_4$ lactate ester and a $C_2$-$C_3$ alcohol. This composition exhibits (a) a reduced amount of odor due to the lactate ester compared to said lactate ester alone and (b) a drying rate at ambient conditions that is about one-half or less of the drying rate of the alcohol alone, when measured at about 80 percent loss of the initial amount of mixed solvent.

A three-part solvent is also contemplated that contains parts A, B and C. This solvent composition comprises as part A, a $C_1$-$C_4$ lactate ester present at about 10 to about 80 percent by weight. Part B comprises a $C_2$-$C_6$ aliphatic alcohol present at about 10 to about 80 percent by weight, and part C comprises a co-solvent present at about 10 to about 80 percent by weight. The combined total of parts A, B and C is 100 percent by weight. This composition (a) exhibits a reduced amount of odor due to the said lactate ester compared to said lactate ester alone and (b) is a homogeneous liquid at zero degrees C.

A preferred part C is a solvent selected from the group consisting of a $C_6$-$C_{12}$ aliphatic hydrocarbon, a $C_6$-$C_8$ aromatic hydrocarbon, a terpene, a ketone containing 3 to about 6 carbon atoms, a methyl ester of a $C_{10}$ to about $C_{18}$ fatty acid, a methyl or ethyl ester of an aliphatic acid having a chain length of 2 to about 6 carbon atoms, and mixtures thereof.

A contemplated blend has several benefits and advantages. One advantage of these blends is that the odor and lingering odor tolerance problem of lactate esters are mitigated so that the lactate esters can be have more widespread use.

A benefit of a contemplated blend is that the primary components of these blends—ethyl lactate, ethanol, n-butanol and such, are environmentally benign, non-toxic and are derived from renewable resources.

Another advantage in cleaning applications is that these blends have lower drying rates than the highly volatile alcohols and this enables them to be in longer contact with the surfaces being cleaned providing better penetration properties.

A further benefit is that these blends have higher salvation properties than the alcohols, and enable the dissolution of higher concentrations of polymers and resins.

Still further benefits and advantages of the present invention will be apparent to the skilled worker from the disclosure that follows.

DETAILED DESCRIPTION OF THE INVENTION

A solvent is contemplated that is a blend of $C_1$-$C_4$ aliphatic esters of lactic acid and $C_2$-$C_6$ alcohols with low odor, high odor tolerance and enhanced solvent properties. A contemplated solvent composition comprises about 90 to about 10 percent by weight $C_1$-$C_4$ lactate ester and about 10 to about 90 percent by weight $C_2$-$C_6$ aliphatic alcohol. The composition (a) exhibits a reduced amount of odor due to the lactate ester compared to the lactate ester alone and (b) is a homogeneous liquid (exhibits a single liquid phase) at zero degrees C. In some preferred solvents, the lactate ester comprises about 10 to about 80 weight percent of the composition. In other embodiments, the $C_2$-$C_6$ aliphatic alcohol comprises about 10 to about 80 weight percent of the said composition. In still other embodiments, the two solvents are present in about equal amounts such as at about 40 to about 60 weight percent of the lactate to about 60 to about 40 weight percent of the alcohol.

It has thus been found, that $C_1$-$C_4$ esters of lactic acid, particularly ethyl lactate, when blended with linear or branched (aliphatic) alcohols containing two to about 6 carbon atoms, such as ethanol, 2-propanol (iso-propanol), 1-propanol (n-propanol), 1-butanol (n-butanol), 2-butanol (iso-butanol), 1-pentanol (n-pentanol), 2-pentanol, 1-hexanol (n-hexanol) or 2-hexanol overcomes the odor and tolerance problems associated with the lactate ester. Of these $C_2$-$C_6$ aliphatic alcohols, the $C_2$-$C_3$ aliphatic alcohols, ethanol, 1-propanol and 2-propanol, are presently preferred in certain embodiments. Illustrative $C_1$-$C_4$ lactate esters have boiling points of less than about 200° C. and include methyl lactate, ethyl lactate, iso-propyl lactate, butyl lactate and allyl lactate, whose boiling points at atmospheric pressure range between about 145° C. and about 190° C.

Furthermore, these solvent blends using the preferred $C_2$-$C_3$ aliphatic alcohols also provide slower drying rates and thus more penetration and cleaning ability than the alcohols themselves. In addition, these blends provide higher solvency for several types of polymers that are used in coatings formulations when compared to the alcohols alone. Thus, this invention also contemplates a solvent composition that comprises a $C_1$-$C_4$ lactate ester and a $C_2$-$C_3$ alcohol. This composition exhibits (a) a reduced amount of odor due to the lactate ester compared to the lactate ester alone and (b) a drying rate at ambient conditions that is about one-half or less of the drying rate of the alcohol alone, when measured at about 80 percent loss of the initial amount of mixed solvent.

A three-part solvent is also contemplated. That solvent composition comprises part A that is a $C_1$-$C_4$ lactate ester present at about 10 to about 80 percent by weight as before, part B that is a $C_2$-$C_6$ aliphatic alcohol present at about 10 to about 80 percent by weight as before, and part C that is a co-solvent present at about 10 to about 80 percent by weight. The combined total of parts A, B and C is 100 percent by weight. This three-part composition (a) exhibits a reduced amount of odor due to the said lactate ester compared to said lactate ester alone and (b) is a homogeneous liquid at zero degrees C.

Illustrative co-solvents, C, include a solvent selected from the group consisting of a $C_6$-$C_{12}$ aliphatic hydrocarbon, a $C_6$-$C_8$ aromatic hydrocarbon, a terpene (preferably from citrus fruit), a ketone containing 3 to about 6 carbon atoms, a methyl ester of a $C_{10}$ to about $C_{18}$ fatty acid, a methyl or ethyl ester of an aliphatic acid having a chain length of 2 to about 6 carbon atoms, and mixtures thereof.

Exemplary $C_6$-$C_{12}$ aliphatic hydrocarbons include hexane, heptane, octane, nonane, decane, undecane and dodecane, as well as their branched isomers such as 2-, and 3-methylhexanes, 2-, 3, and 4-methylheptanes, 2- and 3-ethylhexanes, 2-, 3-, 4-, and 5-methyldecanes, and the like. Exemplary $C_6$-$C_8$ aromatic hydrocarbons include benzene, toluene, ortho-, meta- and para-xylenes.

Terpenes are a large and varied class of hydrocarbons, produced primarily by a wide variety of plants, particularly conifers, although also by some insects such as swallowtail butterflies. Terpenes are derived biosynthetically from units of isoprene, which has the molecular formula $C_5H_8$. The basic molecular formulas of terpenes are multiples of the building block unit, $(C_5H_8)_n$ where n is the number of linked isoprene units. The isoprene units can be linked together "head to tail" to form linear chains or they can be arranged to form rings. Isoprene itself does not undergo the building process, but rather activated forms such as isopentenyl pyrophosphate and dimethylallyl pyrophosphate (DMAPP or also dimethylallyl diphosphate), are the components in the biosynthetic pathway. Terpenes obtained or derived from citrus fruits and those obtained from coniferous plants are particularly preferred for use herein, with citrus-derived terpenes and especially d-limonene, being particularly preferred.

d-Limonene is the primary terpene obtained from citrus fruit, with linalool, a terpene alcohol being another primary ingredient of citrus terpenes. d-Limonene is commercially available from Florida Chemical Co., Inc. of Winter Haven, Fla. Exemplary terpenes from coniferous plants (conifers) include camphene, myrcene, α-pinene and β-pinene, and p-cymene that is an aromatic related to terpenes. Coniferous terpenes and pine-derived hydrocarbons and alcohols, obtained from turpentine are also available from Florida Chemical Co., Inc.

A ketone containing 3 to about 6 carbon atoms is also a preferred co-solvent, C. Illustrative $C_3$-$C_6$ ketones include acetone, methyl ethyl ketone, methyl iso-butyl ketone, methyl iso-propyl ketone, diethyl ketone, ethyl iso-propyl ketone, ethyl n-propyl ketone, cyclopentanone, and cyclohexanone. The use of methyl ethyl ketone, methyl iso-butyl ketone and cyclohexanone are particularly preferred.

Another preferred co-solvent is a methyl ester of a $C_{10}$ to about $C_{18}$ fatty carboxylic acid. Illustrative solvent esters include the methyl esters of capric acid, lauric acid, myristic acid, palmitic acid, stearic acid, oleic acid, linoleic acid and linolenic acid. A further group of preferred so-solvents solvents are the methyl and ethyl ($C_1$-$C_2$) esters of aliphatic carboxylic acid having a chain length of 2 to about 6 carbons ($C_2$-$C_6$). Illustrative $C_2$-$C_6$ aliphatic carboxylic acids include acetic acid, propionic acid, butyric acid, iso-butyric acid, valeric acid and caproic acid.

It is also to be understood that a mixture that contains a plurality of individual co-solvent compounds can be utilized in a contemplated solvent.

The components of a three-part solvent are preferably utilized in proportions in which parts A and B (lactate ester and alcohol) together constitute about 50 to about 80 weight percent of the solvent and part C, the other solvent, constitutes about 50 to about 20 weight percent. More preferably still, component parts A and B constitute about 60 to about 70 weight percent of the mixed solvent and the other solvent, part C, constitutes about 40 to about 30 weight percent.

Component parts A and C of a mixed three-part solvent can each be present at about 10 to about 80 percent by weight. Preferably, they are present at a weight ratio of about 1:2 to about 2:1, and more preferably at about 2:3 to about 3:2. More preferably, a $C_1$-$C_4$ lactate ester and other solvent (component parts A and C) are present in about equal proportions by weight. All three solvent components can also be present in approximately equal amounts, e.g., at weight ratios of about 3:3:4, or 4:3:3 or 3:4:3.

The following examples are provided to support the present invention.

Example 1

This example provides the evidence for the novel discovery of odor mitigation and enhanced tolerance for long exposure to lactate esters.

The odor/irritation tolerance tests were conducted with two human volunteers (subjects) that agreed to breathe the vapor from the solvent blend test samples according to a prescribed method and provide their reactions, which were recorded.

At the start of the tests, several drops of the solvent sample were spread on a piece of tissue paper and the subject held it close to the nose (~3 to 4 inches away) and continually breathed in the vapor as he/she sat at a table. This closeness to the solvent was far greater than usually practiced by a solvent user whose nose would be several feet away from a solvent soaked towel or rag. This test therefore, exaggerated and artificially shortened the time a user would remain in contact with a lactate ester containing solvent composition.

From the start of the test, the time for various events or sensations that the subject felt, were recorded. First, the subjects would get a "bite" sensation and the time for this was recorded as the close breathing of the vapor continued. Then the time for the onset of irritation and continuing of irritation was noted. Whether the irritation continually increased or stayed at a low level was recorded. If the subject decided to quit because of continued and increasing irritation, this time was also noted. In any case, the breathing test was stopped after 5 minutes, which, for such close and continual breathing of the solvent vapors was considered to be adequate for measure of the irritation level and its mitigation. Between tests of different samples the subject went away from the room, drank water if desired, breathed fresh air and did other work for at least 10 minutes before coming back for the next sample. The results are summarized in Table 1.

TABLE 1

| | | Odor Tolerance Test Results of Lactate Esters with aliphatic alcohols | | |
|---|---|---|---|---|
| Solvent and Solvent Blend | Composition (ratio parts w:w; lactate:alcohol) | Subject 1 | Subject 2 | Summary Comments |
| Ethyl lactate (EL) | 100 | Onset of bite sensation: 35 sec<br>Continuing: Yes<br>Stoppage due to increased bite: Yes<br>Final time to stoppage: 60 sec | Onset of bite sensation: 10 sec<br>Continuing: Yes<br>Stoppage due to increased bite: Yes<br>Final time to stoppage: 65 sec | Base line data on EL as control |
| Ethyl lactate (EL) and n-Butanol (n-BuOH) | 80:20 | Onset of bite sensation: 120 sec<br>Continuing: moderate<br>Stoppage due to increased bite: Yes<br>Final time to stoppage: 240 sec | Onset of bite sensation: 130 sec<br>Continuing: moderate<br>Stoppage due to increased bite: No<br>Final time to stoppage: >300 sec | Very significant increase in tolerance level and reduction of the bite sensation |
| EL and n-BuOH | 50:50 | Onset of bite sensation: none<br>Continuing: tolerable<br>Stoppage due to increased bite: No<br>Final time to stoppage: >300 sec | Onset of bite sensation: 210 sec<br>Continuing: tolerable<br>Stoppage due to increased bite: No<br>Final time to stoppage: >300 sec | Very tolerable in both odor and bite sensation |
| EL and Ethanol | 50:50 | Onset of bite sensation: 125 sec<br>Continuing: moderate<br>Stoppage due to increased bite: Yes<br>Final time to stoppage: >210 sec | Onset of bite sensation: 30 sec<br>Continuing: moderate<br>Stoppage due to increased bite: No<br>Final time to stoppage: >300 sec | Very significant increase in tolerance level and reduction of the bite sensation |
| EL and iso-propanol (IPA) | 50:50 | Onset of bite sensation: 180 sec<br>Continuing: moderate<br>Stoppage due to increased bite: Yes<br>Final time to stoppage: 220 sec | Onset of bite sensation: 190 sec<br>Continuing: moderate<br>Stoppage due to increased bite: No<br>Final time to stoppage: >300 sec | Very significant increase in tolerance level and reduction of the bite sensation |

TABLE 1-continued

| Solvent and Solvent Blend | Composition (ratio parts w:w; lactate:alcohol) | Odor Tolerance Test Results of Lactate Esters with aliphatic alcohols: Subject 1 | Subject 2 | Summary Comments |
|---|---|---|---|---|
| EL and IPA | 20:80 | Onset of bite sensation: 290 sec Continuing: tolerable Stoppage due to increased bite: No Final time to stoppage: >300 sec | Onset of bite sensation: 160 sec Continuing: tolerable Stoppage due to increased bite: No Final time to stoppage: >300 sec | Very tolerable in both odor and bite sensation |
| EL and n-Pentanol | 50:50 | Onset of bite sensation: 180 sec Continuing: tolerable Stoppage due to increased bite: No Final time to stoppage: >300 sec | Onset of bite sensation: 120 sec Continuing: tolerable Stoppage due to increased bite: No Final time to stoppage: >300 sec | Very significant increase in tolerance level and reduction of the bite sensation |
| EL and n-hexanol | 50:50 | Onset of bite sensation: 80 sec Continuing: moderate Stoppage due to increased bite: yes Final time to stoppage: 225 sec | Onset of bite sensation: 90 sec Continuing: moderate Stoppage due to increased bite: No Final time to stoppage: >300 sec | Significant increase in tolerance level and reduction of the bite sensation |
| EL and iso-butanol | 80:20 | Onset of bite sensation: 160 sec Continuing: moderate Stoppage due to increased bite: yes Final time to stoppage: 200 sec | Onset of bite sensation: 110 sec Continuing: moderate Stoppage due to increased bite: No Final time to stoppage: >300 sec | Very significant increase in tolerance level and reduction of the bite sensation |
| EL and iso-butanol | 50:50 | Onset of bite sensation: 200 sec Continuing: tolerable Stoppage due to increased bite: No Final time to stoppage: >300 sec | Onset of bite sensation: 190 sec Continuing: tolerable Stoppage due to increased bite: No Final time to stoppage: >300 sec | Very tolerable in both odor and bite sensation |

The above results show that addition of such aliphatic alcohols to lactate esters provides a very significant increase in the tolerance level and reduction of the bite sensation and some of the blends provide highly tolerable properties in both odor and the bite sensation. This finding is totally unexpected. Alcohols with a wide range of volatilities from $C_2$ to $C_6$ are found to be useful. It is very serendipitous that many of these alcohols are solvents in themselves and mixing them with lactate esters can increase their solvency properties while simultaneously increasing the odor tolerance levels for the esters.

Example 2

Blends of lactate esters and d-limonene, a biobased solvent that is derived from citrus fruits have improved cleaning and solvent properties. Lactate esters can also be blended with fatty acid esters and other aliphatic acid ester containing co-solvents to provide biosolvent blends with enhanced solvating, cleaning and penetration properties. Similarly lactate esters can be blended with other non-alcohol and non-ester co-solvents such as ketones, aromatic and aliphatic hydrocarbons and with mixtures of all of these solvents because lactate esters are very miscible in both hydrophobic and hydrophilic solvents. For example, lactate esters are highly miscible in many aliphatic hydrocarbons such as hexane, heptane, octane and such; many aromatic hydrocarbons such as toluene, xylenes and such. They are also freely miscible in many ketone solvents such as acetone, methyl ethyl ketone, methyl isobutyl ketone, and methyl amyl ketone and such.

This example provides further evidence that dilution with these solvents alone does not provide odor and tolerance mitigation (Table 2), but when a blend of lactate esters and alcohols are added to these solvents the odor perception and tolerance is very significantly enhanced (Table 3).

TABLE 2

| Solvent and Solvent Blend | Composition (ratio parts w:w; lactate:other) | Odor Tolerance Test Results of Lactate Esters with co-solvent d-limonene: Subject 1 | Subject 2 | Summary Comments |
|---|---|---|---|---|
| Ethyl lactate (EL) | 100 | Onset of bite sensation: 35 sec Continuing: Yes Stoppage due to increased bite: Yes Final time to stoppage: 60 sec | Onset of bite sensation: 10 sec Continuing: Yes Stoppage due to increased bite: Yes Final time to stoppage: 65 sec | Base line data on EL as control |
| Ethyl lactate (EL) and d-limonene | 50:50 | Onset of bite sensation: 30 sec Continuing: Yes Stoppage due to increased bite: Yes Final time to stoppage: 52 sec | Onset of bite sensation: 25 sec Continuing: Yes Stoppage due to increased bite: Yes Final time to stoppage: 60 sec | No increase in tolerance level and reduction of the bite sensation |

Similar negative results of no increase in tolerance were observed with the blending with the other types of solvents that are mentioned above.

TABLE 3

| Solvent and Solvent Blend | Composition (ratio parts w:w; lactate:other | Odor Tolerance Test Results of Lactate Esters with added alcohols with co-solvent d-limonene: Subject 1 | Subject 2 | Summary Comments |
|---|---|---|---|---|
| Ethyl lactate (EL) | 100 | Onset of bite sensation: 35 sec Continuing: Yes Stoppage due to increased bite: Yes Final time to stoppage: 60 sec | Onset of bite sensation: 10 sec Continuing: Yes Stoppage due to increased bite: Yes Final time to stoppage: 65 sec | Base line data on EL as control |
| Ethyl lactate (EL) and d-limonene | 50:50 | Onset of bite sensation: 30 sec Continuing: Yes Stoppage due to increased bite: Yes Final time to stoppage: 52 sec | Onset of bite sensation: 25 sec Continuing: Yes Stoppage due to increased bite: Yes Final time to stoppage: 60 sec | No increase in tolerance level and reduction of the bite sensation |
| Ethyl lactate (EL) d-limonene and n-BuOH | 45:45:10 | Onset of bite sensation: 130 sec Continuing: moderate Stoppage due to increased bite: Yes Final time to stoppage: 240 sec | Onset of bite sensation 140 sec: Continuing: moderate Stoppage due to increased bite: Yes Final time of stoppage: 270 sec | Very significant increase in tolerance level and reduction of the bite sensation |
| Ethyl lactate (EL) d-limonene and n-BuOH | 40:40:20 | Onset of bite sensation: 250 sec Continuing: Tolerable Stoppage due to increased bite: No Final time to stoppage: >300 sec | Onset of bite sensation: 160 sec Continuing: Tolerable Stoppage due to increased bite: No Final time to stoppage: >300 sec | Very tolerable in both odor and bite sensation |

Thus, addition of small quantities of aliphatic alcohols to such blends of lactate esters with co-solvents or mixtures of co-solvents led to very significant enhancement in tolerance and provided blends that have very tolerable properties.

Example 3

This example provides evidence for another advantage in that these blends have lower drying rates than the highly volatile alcohols and this enables them to be in longer contact with the surfaces being cleaned, providing better penetration properties. Moreover, these blends are homogeneous liquids at a wide range of temperatures between −10° C. to >70° C.

In a simple study, drying rates were determined using the following procedure:

A 3-inch square swatch of a blue Kimtex® shop towel was placed on top of a 250 ml beaker. The tare weight on the balance is determined, and twelve drops of the prospective solvent are added onto the center of the swatch. The weight is recorded. The solvent is permitted to evaporate at ambient conditions, and the time taken for the solvent to evaporate is measured.

TABLE 4

Evaporative loss of solvents and blends: Comparative tests

| Composition | Time (hours; hr) | Mass (grams; g) | mass lost (g) | % Loss | Rate (g/hr) |
|---|---|---|---|---|---|
| Ethyl Lactate | 0.00 | 0.28 | 0 | 0.0% | 0 |
| | 0.08 | 0.27 | 0.01 | 3.6% | 0.120 |
| | 0.17 | 0.26 | 0.02 | 7.1% | 0.120 |
| | 0.50 | 0.2 | 0.08 | 28.6% | 0.160 |
| | 1.00 | 0.13 | 0.15 | 53.6% | 0.150 |
| Ethanol | 0.00 | 0.20 | 0 | 0% | 0 |
| | 0.08 | 0.11 | 0.09 | 82% | 1.08 |
| | 0.17 | 0.02 | 0.18 | 90% | 1.08 |
| EL/Ethanol (50:50 W:W) | 0.00 | 0.25 | 0 | 0% | 0 |
| | 0.08 | 0.18 | 0.07 | 39% | 0.840 |
| | 0.17 | 0.13 | 0.12 | 48% | 0.720 |
| | 0.50 | 0.06 | 0.19 | 76% | 0.380 |
| Iso-propanol | 0.00 | 0.21 | 0 | 0% | 0 |
| | 0.08 | 0.13 | 0.08 | 38% | 0.96 |
| | 0.17 | 0.04 | 0.17 | 81% | 1.02 |
| EL/Iso-propanol (50:50 W:W) | 0.00 | 0.23 | 0 | 0% | 0 |
| | 0.08 | 0.17 | 0.06 | 26% | 0.720 |
| | 0.17 | 0.12 | 0.11 | 48% | 0.660 |
| | 0.50 | 0.04 | 0.19 | 83% | 0.380 |
| n-Butanol | 0.00 | 0.24 | 0 | 0% | 0 |
| | 0.08 | 0.22 | 0.02 | 8% | 0.240 |
| | 0.17 | 0.19 | 0.05 | 21% | 0.300 |
| | 0.50 | 0.06 | 0.18 | 75% | 0.360 |
| EL/n-Butanol (50:50 W:W) | 0.00 | 0.26 | 0 | 0% | 0 |
| | 0.08 | 0.24 | 0.02 | 8% | 0.240 |
| | 0.17 | 0.22 | 0.04 | 15% | 0.240 |
| | 0.50 | 0.13 | 0.13 | 50% | 0.260 |
| | 1.00 | 0.01 | 0.25 | 96% | 0.250 |

The volatile alcohols, particularly ethanol and iso-propanol, are very fast drying and have lower solvency than ethyl lactate. Thus, for many cleaning applications, these solvents dry too quickly and do not penetrate and dissolve the impurities. Ethyl lactate is known to be slower drying solvent with high solvency but for many cleaning applications its drying rate is too low. The data from this example show that when blended with a contemplated $C_1$-$C_4$ lactate ester such as ethyl lactate, the drying rates of the $C_2$-$C_3$ alcohol at a time when about 80 percent of the initially present solvent mixture has evaporated is about one-half or less of the rate compared to the alcohols alone.

For example, the drying rate for ethanol alone at 82 percent loss (0.08 hours) is 1.08 g/hr, whereas the rate for the ethyl lactate/ethanol mixture at 76 percent loss (0.50 hours) is 0.380 g/hr. Similarly, for iso-propyl alcohol, the drying rate for the alcohol alone at 81 percent loss (0.17 hours) was 1.02 g/hr, whereas the rate for the mixture at 83 percent loss (0.5 hours) was 0.380 g/hr. Thus the solvent blends of this invention can provide very desirable longer drying rates together with high solvency and penetration.

Example 4

This example provides evidence for another advantage that the solubility of polyester resins such as cellulose acetate, that are widely used in making fibers and films are very significantly enhanced in the biosolvent blends of lactate esters and alcohols over the alcohols themselves. This enhanced solubility can enable the use of renewable resource based solvents to be used in polyester resin applications.

Cellulose acetate of the degree of acetylation of 40%, obtained from Eastman Chemical Company (CA-398-3), was dissolved to a saturated solution in the solvent, after removal of the undissolved solids the liquid sample was dried to constant weight under an infra-red lamp. The data summarized in Table 5 clearly show that the solubility of the polyester is very significantly increased as ethyl lactate is added to the alcohol.

TABLE 5

Solubility of polyester—cellulose acetate resin in solvent blends

| Solvent Composition | Cellulose acetate solubility (% w/w) | Increase in solubility (X fold) |
|---|---|---|
| n-Butanol | 0.02% | 1 |
| n-Butanol/Ethyl Lactate (50:50 W:W) | 0.13% | 6.7 |
| n-Butanol + Ethyl Lactate (20:80 W:W) | 7.44% | 372.2 |

Each of the patent applications, patents and articles cited herein is incorporated by reference. The use of the article "a" or "an" is intended to include one or more.

The foregoing description and the examples are intended as illustrative and are not to be taken as limiting. Still other variations within the spirit and scope of this invention are possible and will readily present themselves to those skilled in the art.

What is claimed is:

1. A solvent composition consisting of A: a $C_1$-$C_4$ lactate ester, B: a $C_2$-$C_6$ aliphatic alcohol, and C: a co-solvent selected from the group consisting of a $C_6$-$C_{12}$ aliphatic hydrocarbon, a $C_6$-$C_8$ aromatic hydrocarbon, a terpene, a ketone containing 3 to about 6 carbon atoms, a methyl ester of a $C_{10}$ to about $C_{18}$ fatty acid, a methyl or ethyl ester of an aliphatic acid having a chain length of 2 to about 6 carbon atoms, and mixtures thereof, and wherein the combined total of A, B and C is 100 percent by weight, wherein A+B together constitute about 50 to about 80 weight percent of the solvent and C constitutes about 50 to about 20 weight percent, and said composition (a) exhibits a reduced amount of odor due to the said lactate ester compared to said lactate ester alone and (b) is a homogeneous liquid at zero degrees C.

2. The solvent composition according to claim 1, wherein solvent C is a terpene.

3. The solvent composition according to claim 1, wherein said terpene is d-limonene.

4. The solvent composition according to claim 1, wherein C is a methyl ester of a fatty acid having a chain length of about 10 to about 18 carbon atoms.

5. The solvent composition according to claim 1, wherein C is an aliphatic hydrocarbon containing 6 to about 12 carbon atoms.

6. The solvent composition according to claim 1, wherein C is an aromatic hydrocarbon containing 6 to about 8 carbon atoms.

7. The solvent composition according to claim 1, wherein C is a ketone that contains 3 to about 6 carbon atoms.

8. The solvent composition according to claim 1, wherein C is methyl or ethyl ester of an aliphatic acid containing 2 to about 6 carbon atoms.

9. The solvent composition according to claim 1, wherein parts A and B (lactate ester and alcohol) together constitute about 60 to about 70 weight percent of the solvent and part C, the other solvent, constitutes about 40 to about 30 weight percent.

* * * * *